US009833054B2

(12) United States Patent
Loza Cebreros

(10) Patent No.: US 9,833,054 B2
(45) **Date of Patent: *Dec. 5, 2017**

(54) DEVICE FOR MAKING ARTIFICIAL NAILS

(71) Applicant: Rafael Loza Cebreros, Guadalajara (MX)

(72) Inventor: Rafael Loza Cebreros, Guadalajara (MX)

( * ) Notice: Subject to any disclaimer, the term of this patent is extended or adjusted under 35 U.S.C. 154(b) by 111 days.

This patent is subject to a terminal disclaimer.

(21) Appl. No.: 14/659,478

(22) Filed: Mar. 16, 2015

(65) Prior Publication Data

US 2015/0250286 A1 Sep. 10, 2015

Related U.S. Application Data

(63) Continuation of application No. 13/883,685, filed as application No. PCT/MX2010/000125 on Nov. 5, 2010, now Pat. No. 8,978,668.

(51) Int. Cl.
*A45D 29/00* (2006.01)
*A45D 31/00* (2006.01)

(52) U.S. Cl.
CPC ..... *A45D 31/00* (2013.01); *A45D 29/00* (2013.01)

(58) Field of Classification Search
CPC ..... A45D 31/00; A45D 29/00; A45D 29/001; A45D 29/004; A45D 29/22
See application file for complete search history.

(56) References Cited

U.S. PATENT DOCUMENTS

| | | | | |
|---|---|---|---|---|
| 4,682,612 | A * | 7/1987 | Giuliano | A45D 31/00 132/73 |
| D426,919 | S * | 6/2000 | Bachik, Jr. | D28/57 |
| 6,357,451 | B1 * | 3/2002 | Carter | A45D 31/00 132/200 |
| 7,654,268 | B2 * | 2/2010 | Carpenter | A45D 31/00 132/285 |
| 2003/0019120 | A1 * | 1/2003 | Davenport | A45D 29/00 33/512 |

* cited by examiner

*Primary Examiner* — Rachel Steitz
(74) *Attorney, Agent, or Firm* — Steven M. Greenberg; CRGO Law

(57) ABSTRACT

The present invention relates to a device for making artificial nails of different lengths and designs, characterized in that they are made from a sheet that has a first smaller side that is straight, two larger sides, each with symmetrical cutaways, the first being a square cutaway, close to the straight side, the second cutaway being the shape of an arch, which is made up of a straight section with two curves at the extremities thereof and the second smaller side, in the central part thereof has a cutaway with an undulating shape creating two "curved valleys" and one "curved crest", followed by a straight side in each of the extremities thereof; a dotted line of symmetry, diagonal dotted lines creating a pair of symmetrical surfaces acting as internal flaps; dotted lines perpendicular to each straight side; a central surface, formed in the device when the internal and external flaps are removed; a removable cover, with the ergonomic design of a human nail; a template, engraved on the central surface on which the artificial nail is formed. Finally, the present invention discloses a means for manufacturing a thumbnail.

17 Claims, 5 Drawing Sheets

DEVICE FOR MAKING ARTIFICIAL NAILS

CROSS-REFERENCE TO RELATED APPLICATIONS

This application is a continuation of U.S. patent application Ser. No. 13/883,685, filed May 9, 2013, entitled "DEVICE FOR MAKING ARTIFICIAL NAILS," now U.S. Pat. No. 8,978,668, which is a U.S. National Stage Patent Application of International Application Number PCT/MX2010/000125, filed Nov. 5, 2010, and entitled "DEVICE FOR MAKING ARTIFICIAL NAILS.

TECHNICAL FIELD OF THE INVENTION

The technical field of this invention is mechanics, specifically the devices which have a template used to make imitation nails for each of the five fingers of the human hand.

Purpose of the invention. To develop a device or "form" with a template which manufactures, through the application of synthetic material, super extra long nails, which are molded into different designs and sizes onto the various types of fingernails that exist on the fingers of the human hand; a second objective of this invention is to ensure that said device attaches firmly to the end of the finger which it is wrapped around, and at the same time can be removed easily once the imitation nail has been formed. The third objective is to prevent the template of the device which has been developed from deforming when synthetic materials are applied to its surface. Finally, the invention seeks to establish a standard for fingernail lengths.

BACKGROUND OF THE INVENTION

In the state of the art, there are various designs for devices (also known by Americans as "forms", for example U.S. Des. 426,919), which are detachable since they are manufactured on sheets of flexible materials and are used primarily for the shaping of imitation fingernails, for example U.S. Pat. No. 6,357,451 describes an apparatus and method for making artificial human fingernails which includes a flexible sheet. Each sheet can be provided with self-adhesive material on one side. A removable cover is formed on the sheet. In addition, a slot can be formed on the sheet to attach to the nail. A plurality of parallel lines placed on the first surface of the sheet adjacent to the slot. A plurality of curved lines which intersect with the number of parallel lines provided on the first surface of the sheet. One or more "flaps" attached to the opposite side of the sheet provided to help to comfortably secure the sheet around the finger. The problem with this technology for devices, forms and/or apparatus is that they can only be used to make mails limited to a maximum of 3 cm long. In addition, it should be noted that as of now there is no pattern or standard which regulates the sizes and tolerances of the length of an artificial nail.

Another of the most common problems associated with "forms" for making artificial fingernails is that they have not managed to produce nails of an extra-large size, since to do this it is almost always necessary to cut two or more "forms" and overlap them so that they can attain a larger surface area; when overlapping them one runs the risk that they will not be well joined and well positioned, since this depends on the skill of the person applying the artificial nails. Furthermore the overlapped "forms" do not make a uniform smooth surface, and worse yet they end up improperly adhering to the finger. In addition, when attempting to make an artificial or prosthetic nail longer than 3 cm, the overlapped "forms" become deformed, since they are not designed to withstand the extra amount of plastic resin, due to the fact that the more resin is used, the greater the weight, and therefore the "form" needs more support at the finger. It should be noted that in the state of the art, there are no forms or devices for making artificial or imitation nails for the thumbs.

DESCRIPTION OF THE INVENTION

The characteristic details of this novel device to form artificial nails are illustrated clearly in the following description and the accompanying figures, which are presented by way of example and should not be considered to be exhaustive for the purposes of this invention.

Figure 1:
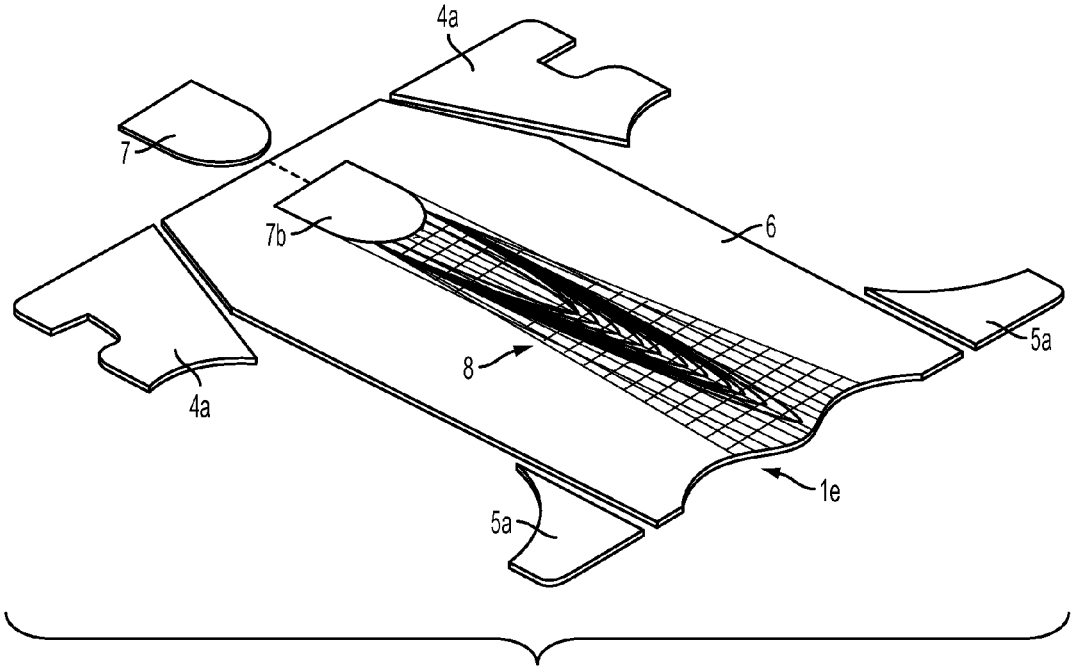
FIG. 1 is a perspective exploded view of the device for making artificial nails.
Figure 2:
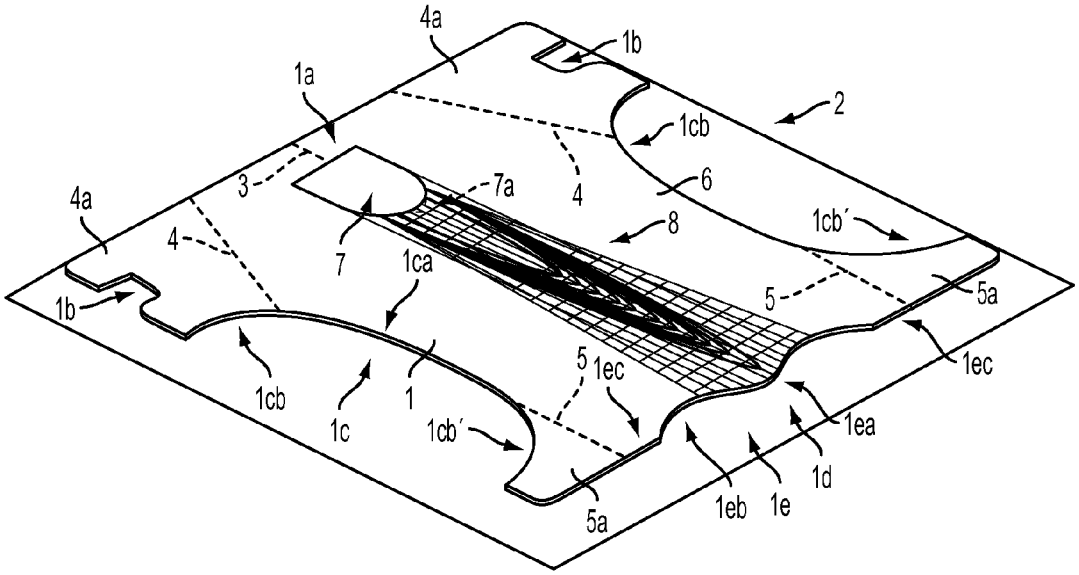
FIG. 2 is a perspective view of the device for making artificial nails integrated and extended.
Figure 3:
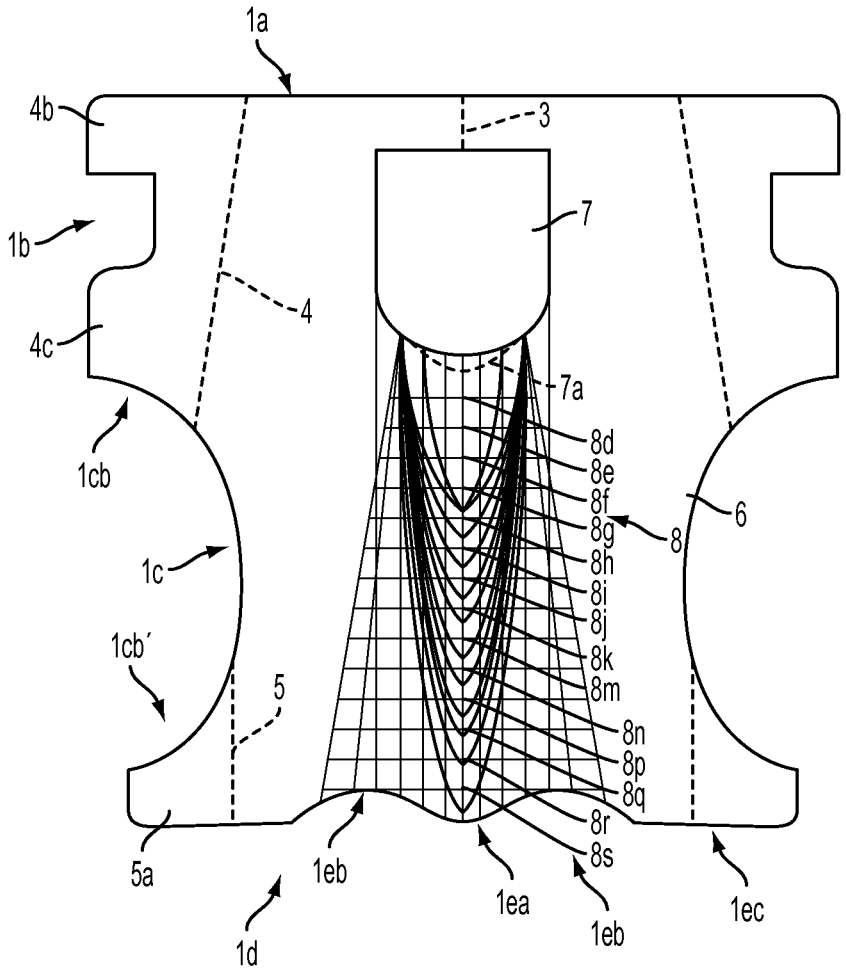
FIG. 3 is a plan view of the device as used to make artificial nails for the thumb.
Figure 4:
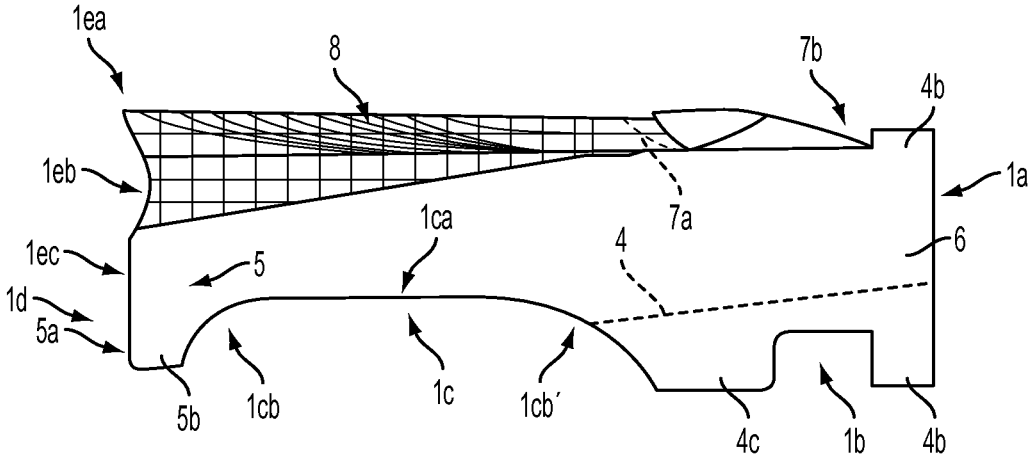
FIG. 4 is a side view of the device for making artificial nails applied to the index finger.
Figure 5:
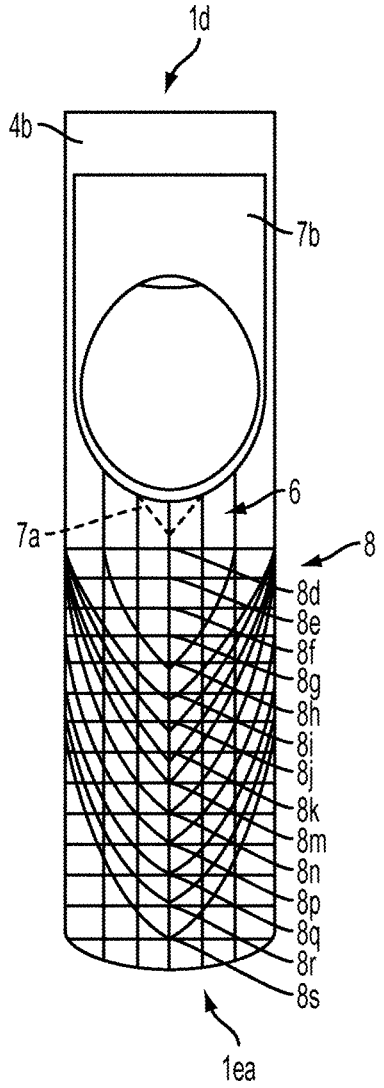
FIG. 5 is a plan view of the device for making artificial nails applied to the index finger.

With respect to these figures, the device for making artificial nails is characterized by being comprised of:

i) a semi-rectangular sheet (1), made out of a flexible metal film, which is adhered to a waxed sheet (2), which in turn has adhesive material on one of its surfaces which allows it to stay attached to the semi-rectangular metal coated sheet, so that the latter is detachable, in addition said semi-rectangular sheet is made up of: a first smaller side which is straight (1*a*), two longer sides, each with symmetrical cutaways, the first being a square cutaway (1*b*), close to the straight side, the second cutaway being the shape of an arch (1*c*), which is made up of a straight section (1*ca*) with two curves ((1*cb*) and (1*cb*')) at the extremities thereof and the second smaller side (1*d*), in the central part thereof has a cutaway with an undulating shape (1*e*) creating two "curved valleys" (1*ea*) and one "curved crest" (1*eb*), followed by a straight side (1*ec*) in each of the extremities thereof;

ii) a dotted symmetry line (3), to indicate the location of the symmetrical axis of the form, goes from the middle of the straight side (1*a*) to the midpoint of the base of a cover described below, the device must be folded along said reference line around the end of the finger;

iii) some diagonal dotted lines (4), which are symmetrical, the ends of which are each located approximately a quarter of the way in from each edge of the smaller straight side (1*a*) and the other ends are located each in the first curve (1*cb*) of the arch-shaped cutout (1*c*). These diagonal dotted lines (4) form two symmetrical surfaces which act as interior flaps (4*a*), which include a square cutout (1*b*), which provides the inside flap with two fastening points, one square (4*b*) and another rectangular (4*c*), once they are folded around the end of the finger, joining together below the finger, with the first fastening point (4*b*), around the finger at the level of the last finger joint and the second fastening point (4*c*), located below the finger, in this way joining to form the first fastener of the device;

iv) some dotted lines (5), that are perpendicular to each straight side (1*ec*), which are located at each end of the undulated cutout (1*e*) of the device, one of the ends of which are located from approximately the midpoint of each straight side (1*ec*), with the other ends located at each end of each straight side (1*ca*) of the arch-shaped cutout (1*c*). These dotted perpendicular lines (5) are symmetrical and create a pair of symmetrical surfaces acting as internal flaps (5*a*), which are called thus because they join together to secure the device off of the finger, each one forming a third fastening point (5*n*) on the device once they adhere to each other, when placed around the end of the finger. In this way, the internal flaps as well as the external ones provide pressure points which hold the device in place and due to the arch-shaped cutout, these flaps hold the thimble around the end of the finger, setting it with greater security;

v) a central surface (6), formed on the device when the internal flaps (4*a*) and external flaps (5*a*) are detached, which is configured as follows: a straight edge which is the remnant of the straight side of the semi-rectangular sheet (1) and two slanted edges remaining from the detachment of the dotted diagonal line (4), in addition to two symmetrical edges which are formed by the arch-shaped cutouts (1*c*) which extend to the shorter side of the device which has the undulated cutout. It should be noted that on this central surface there is an engraved template which will be described further on and there is also;

vi) a removable cover (7), with the ergonomic design of a human nail, which when removed leaves a hole with the shape of a nail, and can thus fit on to any of the four human fingers—index, middle, ring and pinky, as for the thumbnail, this invention includes a special provision. This cover (7) is located near the center of the shorter straight side of the device and includes some dotted extension lines (7*a*) located along the curvature of the cover, which once removed make it possible to extend the empty space (7*b*) left by the cover (7), this allows the device to fit onto the hyponychium of those fingers whose nails are extremely short, that is where the fingertip extends longer than the mail. Between the base of the cover and the first straight side, a small rectangular area is formed which creates a strip that goes around the fingertip near the last joint of the finger, making it possible to detach the device by using said strip;

vii) a template (8), engraved on the central surface (6), the perimeter of which is trapezoidal in shape, the smaller base of which is formed by the dotted lines (7*a*) of the cover (7), and the longer base of which is located at the undulating cutout, and the length of which is the same length as the arch-shaped cutouts (1*c*) and the external flaps (5*a*), it should be added that the template includes a plurality of parallel lines that are 3 mm apart, which delimit the sizes or proportion of the length of the nail. In addition there is a plurality of perpendicular lines, which together with the parallel lines form a grid which makes it possible to establish the width and length of the artificial nail, along with a plurality of curved lines which make it possible to form artificial nails with curves of different sizes, and which are numbered in ascending order as numbers 1, 2, 3 . . . with the first letter of the English words "small", "medium", "large", "extra large", etc., thus forming a row of numbers and letters that run along the symmetric axis of the device, providing it with reference points that indicate the possible dimensions and forms of the artificial piece. This row of reference points begins from the perpendicular line that is closest to the detachable cover (7) and ends at the "curved valley" (1*a*) of the undulated cutout (1*c*), with the following order and sequence:

| Row of lengths (nails) | | Length of artificial nail |
|---|---|---|
| 1 | (8d) | 3 |
| S | (8e) | 6 |
| 3 | (8f) | 9 |
| M | (8g) | 12 |
| 5 | (8h) | 15 |
| L | (8i) | 18 |
| 7 | (8j) | 21 |
| XL | (8k) | 24 |
| 9 | (8m) | 27 |
| SL | (8n) | 30 |
| 11 | (8p) | 33 |
| XXL | (8q) | 36 |
| 13 | (8r) | 39 |
| SXXL | (8s) | 42 |

It is important to note that the underside of both the internal flaps (4*a*) and external flaps (5*a*) have a covering of glue which remains attached to them once the device has been removed from the waxed sheet (2), and therefore since they are symmetrical they can join together around the end of the finger. It should also be noted that no device, apparatus or "form" has been able to achieve the measurements of XL (extra long), 9, SL (super long), 11, XXL (double extra long), 13, SXXL (super double extra long). The maximum lengths achieved by the devices and forms in the state of the art are between 25 and 30 mm.

Version of the Device for Making Artificial Thumbnails.

This invention presents as an option a second device which has identical characteristics to the first, but with the difference that the cover and the template are widened so that the second device can fit the thumbnail.

Method for producing an artificial fingernail using the device in the present invention.

i. Detach the dotted lines to separate a waxed sheet from the roll with an extended device.

ii. Detach it.

iii. Detach the cover (7) for fingernails.

iv. Place the device on the end of and around the finger of the user, while fitting their nail in the empty space (7*b*) left by the cover (7) of the device.

v. Fold the internal flaps (4*a*) around the end of the finger at around the last joint, joining them to form the first fastener of the device.

vi. Fold the external flaps (5*a*) and join them.

vii. Use a brush to apply a gel or powder-based polymer, synthetic resin or monomer with acrylic on the central surface (6) to form a nail according to the desired patterns on the template (8).

viii. Cut along the dotted lines on the internal flaps (4*a*) and external flaps (5*a*) and remove them.

ix. Remove the central surface from the finger.

Based on everything described above, we can affirm that this device for making artificial nails provides the following benefits:

it can produce extra-large sized nails;

it has a cover and a cavity for thumbnails;

it has a guide for cutting the hyponychium;

it features flaps which function as supports;

point "C" for aesthetic finish;

it has a multiple guide with lines of different colors to make different nail designs or styles;

it is manufactured in light or anti-glare tones, since it is necessary to keep one's eyes on the template in order to form the artificial nail;

it is easily removed because there is only a small surface underneath the cover of the device which forms a strip that can be used to remove it with little trouble.

The invention claimed is:

1. A device for making artificial nails from a synthetic material comprising:

a flexible metallic film sheet made of a flexible metal film adhered to a waxed sheet with an adhesive, the sheet comprising:

a removable cover having a base and an ergonomic design of a human fingernail, which when removed defines a hole shaped as a fingernail;

a dotted symmetry line indicating a location of a symmetrical axis of the device;

a first small side which is straight, the first small side having a midpoint and two ends and two long opposing sides, each defining a first and a second symmetrical cutaway, the first cutaway being square-shaped and located near the first small side, the second cutaway being arch-shaped comprising a straight section bounded by a first curve and a second curve, a second small side opposite the first small side, the second small side having a central part defining a third cutaway having an undulating shape creating two curved valleys and one curved crest;

a pair of symmetrical internal flaps and a pair of external flaps to fasten the device on a finger of a human hand;

a central surface having a template with a grid for making artificial nails of different sizes ranging from 3 mm to 42 mm.

2. The device of claim 1, wherein the metallic film-coated plastic sheet is semi-rectangular.

3. The device of claim 1, wherein the removable cover is perforated.

4. The device of claim 1, wherein the removable cover is sized to fit a human thumbnail.

5. The device of claim 1, wherein the dotted symmetry line extends from a midpoint of the first small side to a midpoint of the base of the cover.

6. The device of claim 1, wherein the pair of symmetrical internal flaps are formed by folding the device along a first pair of symmetrical diagonal lines, each having two ends, one end of each symmetrical diagonal line located approximately a quarter of the way in from each edge of the first small side and the other ends located each in the first curve of the second cutaway.

7. The device of clam 6, wherein each symmetrical internal flap comprises two fastening points which, once the internal flaps are folded around an end of the finger, join together beneath the finger, with the first fastening point located around the finger at a finger joint.

8. The device of claim 6, wherein the central surface is formed when the internal flaps and external flaps are detached.

9. The device of claim 8, wherein the central surface comprises:

a straight edge which is a remnant of the first small side of the metallic film-coated plastic sheet;

two slanted edges remaining from detachment along the symmetrical diagonal lines; and two symmetrical edges formed by the second cutaways which extend to the second small side of the device.

10. The device of claim 1, wherein the template is trapezoidal-shaped having:

a small base formed by the cover; and a long base located at a third cutaway.

11. The device of claim 10, wherein the template further comprises a plurality of parallel lines, located 3 mm apart, which delimit a length of the artificial nail.

12. The device of claim 11, wherein the parallel lines are numbered in ascending order.

13. The device of claim 11, wherein the template further comprises a plurality of perpendicular lines, which together with the parallel lines form the grid for establishing a width and length of the artificial nail.

14. The device of claim 13, wherein the template further comprises a plurality of curved lines to form artificial nails with curves of different sizes.

15. The device of claim 10, wherein the template further comprises dotted extension lines along a curvature of the removable cover, which upon removal, allows the device to fit onto a hyponychium of a finger when a fingertip of the finger extends beyond the fingernail.

16. The device of claim 1, wherein the template is engraved on the central surface.

17. The device of claim 1, further comprising a wax-coated sheet having:

a first surface, a second surface, and adhesive material on one of the surfaces which attaches the waxcoated sheet to the metal film-coated plastic sheet so that the wax-coated sheet is removable.

* * * * *